US008635891B1

(12) United States Patent
Tolomei

(10) Patent No.: US 8,635,891 B1
(45) Date of Patent: Jan. 28, 2014

(54) COMBINATION LOCK INCORPORATING COMBINATION

(76) Inventor: John Tolomei, Lake Zurich, IL (US)

( * ) Notice: Subject to any disclaimer, the term of this patent is extended or adjusted under 35 U.S.C. 154(b) by 126 days.

(21) Appl. No.: 13/134,270

(22) Filed: Jun. 2, 2011

(51) Int. Cl.
*E05B 37/00* (2006.01)

(52) U.S. Cl.
USPC ..... 70/24; 70/22; 70/53; 70/286; 70/330; 70/442

(58) Field of Classification Search
USPC ..... 70/22, 24, 25, 26, 53, 286, 315, 330, 70/332, 432, 435, 437, 442–444, 446
See application file for complete search history.

(56) References Cited

U.S. PATENT DOCUMENTS

| | | | | |
|---|---|---|---|---|
| 5,134,862 | A * | 8/1992 | Giehl | 70/49 |
| 5,595,081 | A * | 1/1997 | Nuzzo et al. | 70/446 |
| 6,470,717 | B1 * | 10/2002 | Yu | 70/25 |
| 6,615,626 | B2 * | 9/2003 | Yu et al. | 70/25 |
| 7,201,026 | B2 * | 4/2007 | Yu | 70/21 |
| 7,458,240 | B1 * | 12/2008 | Miao | 70/21 |
| 7,523,628 | B2 * | 4/2009 | Yu | 70/21 |
| 7,552,607 | B2 * | 6/2009 | Yang | 70/21 |
| 7,571,627 | B2 * | 8/2009 | Yu | 70/21 |
| 7,857,363 | B2 * | 12/2010 | Navarsky | 70/49 |

* cited by examiner

*Primary Examiner* — Christopher Boswell
(74) *Attorney, Agent, or Firm* — Kajane McManus; John Tolomei

(57) ABSTRACT

The hasp type combination lock incorporates the numeric combination for the lock on the hasp thereof in a manner where the numeric combination is visible when the hasp is open and not visible when the hasp is closed.

3 Claims, 1 Drawing Sheet

COMBINATION LOCK INCORPORATING COMBINATION

BACKGROUND OF THE INVENTION

1. Field of the Invention

The present invention relates to hasp type locks which require a numeric combination to open same. These types of locks are usually in the form of a standard combination lock or a barrel combination lock. The present invention incorporates the numeric combination onto a hasp of the lock which is visible when the hasp is open and not visible when the hasp is closed.

2. Prior Art

To date, no such structure is believed to have been proposed.

SUMMARY OF THE INVENTION

According to the invention there is provided a combination lock wherein the combination is revealed at least in part on a portion of the lock when the lock is in an open position and the revealed portion of the combination is at least partially obscured when the lock is in a closed position.

According to a preferred form of the invention there is provided a hasp type combination lock incorporating the sequenced character combination for the lock on the hasp thereof in a manner where the character combination is visible at least in part when the hasp is open and not visible when the hasp is closed.

DESCRIPTION OF THE PREFERRED EMBODIMENTS

Figure 1:
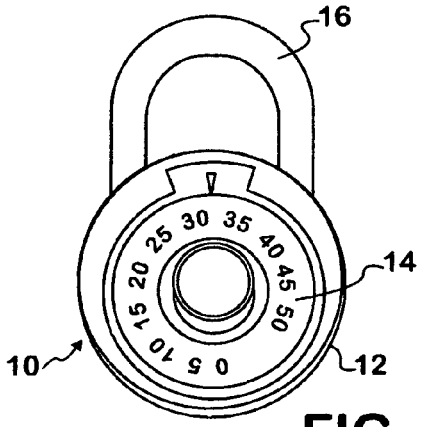
FIG. 1 shows a standard hasp type combination lock with the hasp thereof in a closed position.

Referring now to the drawings in greater detail, there is illustrated in FIG. 1 a combination lock 10, considered standard, showing same to incorporate a body 12 having a combination dial 14 on one surface thereof for inputting characters of the combination in alternating directions of rotation and showing a hasp 16 of the lock seated within a cooperating lock port (not shown) in a periphery of the body 12, the lock 10 being shown in its locked position.

Figure 2:
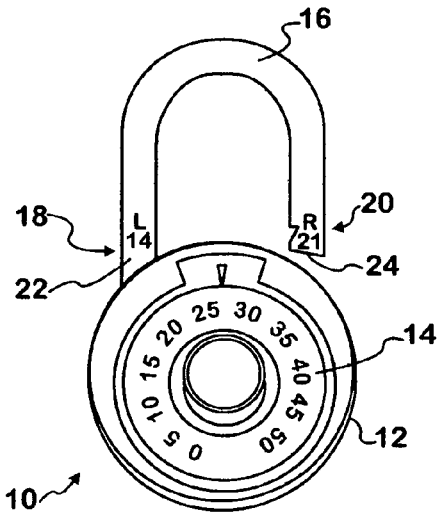
FIG. 2 shows the lock of claim 1 with the hasp pivoted in a first direction, showing a first number of the combination and direction thereon.

FIG. 2 shows the hasp 16 of the lock 10 disengaged from the body 12, and positioned directly over the body 12 of the lock 10, and shows two numerals and their respective associated directions incorporated on areas, 18 and 20, respectively, of the hasp 16 which will seat within the body 12 of the lock 10 when the hasp is locked, as in FIG. 1. Area 18 presents a character in the form of a first numeral, and turn direction left, and is adjacent the body 12 on a slidably engaged end 22 of the hasp 16, and area 20 is adjacent a free end 24 of the hasp 16, presents a second numeral and turn direction right, and is adjacent a port in the body 12 into which the free end 24 is seated to engage the hasp 16 and body 12 together.

Figure 3:
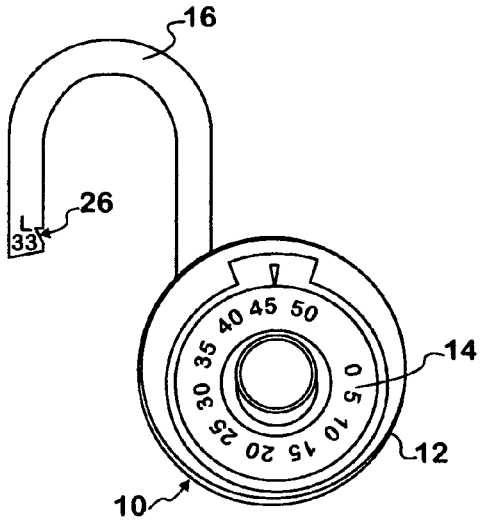
FIG. 3 shows the lock of claim 1 with the hasp pivoted in a second direction and showing the further numbers of the combination, with directions, thereon.

Turning now to FIG. 3, the hasp 16 of the lock 10 of FIG. 2 is also shown disengaged from the body 12, the lock 10 again being in an open position, the hasp 16 being pivoted in a direction away from the body 12, and further shows an area 26 having a turn direction and a numeral incorporated on the area 26, directly opposite area 20, which seats within the port therefor when the hasp 16 is locked to the body 12, as in FIG. 1.

Figure 4:
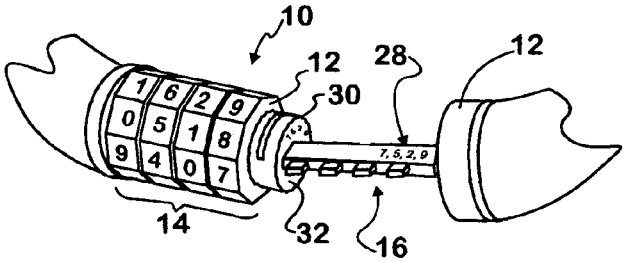
FIG. 4 shows a barrel lock incorporating a numeric combination therefore on a hasp of the lock.

FIG. 4 shows another form of combination lock 10, referred to as a barrel lock 10, the hasp 16 of the barrel lock 10 being shown in an open position thereof and showing an area 28 having a character combination for the lock 10 in the order to be entered on the dial portion 14 of the barrel lock 10, printed on the hasp 16.

It will be understood from the above that the combination required for opening each respective lock 10 is presented on a hasp 16 of the particular lock 10, by any suitable means including printing, engraving, embossing stamping, etc., such that a user is always able to read the combination if the lock 10 is not used for a while and perhaps left in a drawer until needed again. So long as the lock 10 is stored in an open position, the user has no need to recall the combination from memory or find where they may have written the combination down as it is available to him on the hasp 16 should the user require use of the lock 10 again some time in the future.

The invention is most useful to small combination locks that have an integral latch or hasp component. The combination is most conveniently incorporated onto the hasp as depicted in the figures. Those skilled in the art will appreciate that a portion of the lock combination may be revealed in a variety of ways when the lock is in an open position and obscured from view when the lock is in a closed position. For example, the combination of the barrel lock 10 of FIG. 4 may have the combination 30 incorporated on a face 32 of the lock body. Thus, in most locks a portion of the combination may be made visible inside or on the lock body itself when the lock is in the open position and blocked from view by the hasp when in a closed position. It is also possible to provide a window through a lock body that exposes an internal component of the lock mechanism on which a portion of the combination is printed whereupon engagement of lock removes the portion of the combination from view through the window.

Those skilled in the art may use the invention in a variety of ways. It is also possible to design a lock with a timed release function so that the lock will automatically open after a period of time. Often the locks described herein are used to temporarily secure items such as lockers or bicycles and only needed to remain in a locked position for a matter of hours. The lock may incorporate means for automatically releasing the hasp after several hours or several days. Thus, if the lock gets stored in a locked position it will automatically open after an extended period of time thereby revealing the combination but not interfering with a short term locking function.

As described above, the lock of the present invention provides a number of advantages, some of which have been described above and others of which are inherent in the invention. Also, modifications may be made to the lock without departing from the teachings herein. Accordingly, the scope of the invention is only to be limited as necessitated by the accompany claims.

The invention claimed is:

1. A hasp type combination lock incorporating a body, a single dial having characters fixed thereon for inputting a combination of the characters to open the lock by turning the dial in alternating directions in accordance with a predetermined sequence of positions for the dial established by the characters, and a cooperating hasp, wherein the characters of the sequenced combination for the lock are incorporated onto the hasp thereof in a manner where the characters are visible when the hasp is open and the characters are obscured when the hasp is closed, the hasp type combination lock having the single dial on one surface of the body with the positional characters appearing thereon, and the body of the lock engaging the cooperating hasp to lock the lock and releasing the hasp to open the lock upon entry of the required sequence of characters in a corresponding direction of turning of the dial, the characters and corresponding turn directions for each character being presented along areas of the hasp which seat within the body of the lock when the lock is in a locked position thereof.

2. The hasp type combination lock of claim 1 wherein the characters and corresponding turn directions for each character are only displayed along areas of the hasp which are exposed when the lock is in an open position thereof, with a free end of the hasp being disconnected from the body of the lock, the characters being positioned on the hasp in a manner that indicates their direction of rotation, and, with respect to the dial of the lock when the hasp is positioned for closure, a first character representing a left dial rotation being located on the left side of the hasp, and a character representing a right dial rotation being located on the right side of the hasp.

3. The hasp type combination lock of claim 2 wherein a character representing another left dial rotation is located on the rearward facing surface of the right side of the hasp.

* * * * *